US005152131A

United States Patent [19]

Locatelli

[11] Patent Number: 5,152,131

[45] Date of Patent: Oct. 6, 1992

[54] DEVICE FOR JOINING TEXTILE YARNS BY COMPRESSED AIR

[75] Inventor: Lorenzo Locatelli, Toscolano, Italy

[73] Assignee: Mesdan S.p.A., Salo' , Italy

[21] Appl. No.: 660,551

[22] Filed: Feb. 26, 1991

[30] Foreign Application Priority Data

Feb. 26, 1990 [IT] Italy ..... 19431 A/90

[51] Int. Cl.[5] ..... D01H 13/26

[52] U.S. Cl. ..... 57/23; 57/22; 57/261; 57/350

[58] Field of Search ..... 57/22-23, 57/350, 261, 202

[56] References Cited

U.S. PATENT DOCUMENTS

| | | | |
|---|---|---|---|
| 3,306,020 | 2/1967 | Rosenstein | 57/202 X |
| 3,339,362 | 8/1967 | Dodson et al. | 57/350 X |
| 4,002,012 | 1/1977 | Norris et al. | 57/22 |
| 4,397,137 | 8/1983 | Davies et al. | 57/22 |
| 4,441,308 | 4/1984 | Rohner et al. | 57/22 |
| 4,452,035 | 6/1984 | Rohner et al. | 57/22 |
| 4,693,067 | 9/1987 | Locatelli | 57/261 |
| 4,938,013 | 7/1990 | Zumfeld | 57/22 |

FOREIGN PATENT DOCUMENTS

| | | |
|---|---|---|
| 0041818 | 12/1981 | European Pat. Off. . |
| 2856514 | 7/1979 | Fed. Rep. of Germany . |
| 3004721 | 8/1982 | Fed. Rep. of Germany . |
| 3049426 | 2/1983 | Fed. Rep. of Germany . |
| 2750913 | 11/1983 | Fed. Rep. of Germany . |
| 3040661 | 9/1984 | Fed. Rep. of Germany . |
| 3540324 | 6/1986 | Fed. Rep. of Germany . |
| 3626374 | 3/1987 | Fed. Rep. of Germany . |
| 3418396 | 3/1988 | Fed. Rep. of Germany . |
| 1137713 | 9/1986 | Italy . |

OTHER PUBLICATIONS 205 142 Italian Utility Model.

*Primary Examiner*—Daniel P. Stodola
*Assistant Examiner*—William Stryjewski
*Attorney, Agent, or Firm*—Longacre & White

[57] ABSTRACT

A device for joining textile yarns by compressed air in which the joining head comprises a longitudinal chamber divided into two parts by a transverse central fissure, at least one air nozzle opening into each of said parts, that nozzle opening into one part creating an air swirl in one direction of rotation and that nozzle opening into the other part creating an oppositely directed air swirl, the air swirls being in the direction of the original twist of the yarns to be joined. In the transverse central fissure there is disposed a separator baffle provided with a yarn positioning region, the baffle physically separating the two parts of the chamber while leaving a central air vent free. To increase the air quantity discharged through the vent, a transverse fissure can also be provided in the cover which frontally closes the chamber during the joining operation.

6 Claims, 7 Drawing Sheets

DEVICE FOR JOINING TEXTILE YARNS BY COMPRESSED AIR

BACKGROUND OF THE INVENTION

This invention relates to a device for joining textile yarns by compressed air without forming a knot, and relates in particular to the joining head of such a device which contains the chamber in which the joining process is carried out, and the cover which during the joining process closes the slot through which the yarns are inserted into the chamber.

Pneumatic joining of textile yarns with the aid of compressed air jets acting within the chamber is a method which has been known for a long time and which during the course of time has undergone considerable development.

Initially the yarns originating from opposite sides of the joining chamber and inserted into it through its insertion slot with their ends retained on the outside of the chamber by suitable retention devices were subjected within the chamber to the direct action of at least one compressed air jet fed generally into the centre of the chamber in order to mix and interlace the fibres under the effect of strong turbulence. Examples of joining devices of this type are described in U.S. Pat. No. 3,461,661 and in German patents 27 50 913 and 28 56 514.

The need to improve interlacing between the fibres by removing the original yarn twist led to methods such as those described in German patents 30 04 721 and 30 40 661 and in European patent 41 818 which, although using different types of pneumatic joining devices have the common concept of inducing untwisting of the ends of the yarns to be joined. Thus German patent 30 04 721 describes a device comprising two separate chambers axially spaced apart in which, if viewed in the same axial direction, a clockwise-rotating air swirl is created in one chamber and an anticlockwise-rotating air swirl is created in the other chamber to untwist the free ends of the yarns to be joined. In German patent 30 40 661 the same result is obtained by a joining device in which the two opposing air swirls are created within a single chamber symmetrical both about a transverse central plane and about a longitudinal central plane. An analogous method, described in European patent 41 818 comprises a joining chamber consisting of two partially touching parallel parts with a common longitudinal slot for introducing the yarns, in which, if viewed in the same direction, a substantially clockwise-rotating air swirl is created in one chamber and a substantially anticlockwise-rotating air swirl is created in the other chamber.

The further development of pneumatic joining devices involved preceding the actual yarn joining operation by a preliminary stage in which their ends were treated to untwist these ends and to open and parallelize the fibres in them. It has consequently been suggested to use chambers arranged to twist rather than untwist the yarns during the operation by the use of air swirls operating in the same direction as the original twist in the yarns to be joined. Examples of joining chambers of this type are described in Italian patent 1,137,713, in Italian utility model 205,142 and in German patents 30 49 426, 34 18 396 and 36 26 374.

There remained the problem of possible mutual negative influence of the two opposing air swirls, generated by nozzles opening into the chamber in positions very close together, this problem having been solved by a method described in German patent 35 40 324, by which the chamber is divided into two parts by a central transverse air bleed fissure between the two nozzles, which open into the two parts of the chamber respectively, so as to create opposing air swirls within said parts. This transverse fissure also results in a reduction in the quantity of air laterally emerging from the respective ends or lateral ports of the chamber.

In this respect, it has been found that a large quantity of air escaping from the lateral ports of the chamber can damage the yarn fibres, especially of soft twist or very short fibre yarns.

Although this latter method is very valid and has given excellent results, it still has certain drawbacks in that after cutting the yarn ends they lie freely within the two parts of the chamber without having a precise position, so that the yarn ends are able to assume poorly defined positions and can be struck by the opposing air swirls in a not always identical manner within the two parts of the chamber. The joints obtained with such a chamber can consequently show undesirable non-uniformity.

SUMMARY OF THE INVENTION

The object of the present invention is to obviate this drawback of chambers of the latterly described type, and thus obtain textile yarn joints with greater uniformity in terms of their resistance to breakage, their length, their thickness and their appearance. This object is attained according to the present invention by a device for joining textile yarns by compressed air, comprising a joining head containing a longitudinal chamber with free exit ports at its ends, a longitudinal slot for introducing the yarns to be joined in the longitudinal chamber and providing communication between the chamber and a resting surface on the joining head, a transverse central air vent fissure connecting the centre of the chamber to the outside and dividing the chamber into two parts, and compressed air nozzles opening into the two parts of the chamber, at least one of said nozzles opening into one part of the chamber and being disposed on one side of a longitudinal plane of symmetry through the chamber, and at least a further one of said nozzles opening into the second part of the chamber and being disposed on the opposite side of said longitudinal plane of symmetry, and further comprising for said longitudinal introduction slot a closure cover controllable to enable one of its surfaces to be brought into temporary contact with said resting surface on the head, the device being characterised in that in said transverse central fissure there is disposed a separator baffle which partly closes the fissure and terminates within the fissure at a distance from the resting surface on the joining head, said separator baffle comprising a recessed region for yarn positioning which is aligned with the two parts of the chamber.

In one embodiment of the joining device according to the invention the contact surface of the cover can also be provided with a transverse fissure in that region which when the cover is closed faces the transverse central fissure provided in the joining head. According to particular embodiments the transverse central fissure provided in the joining head can comprise bevels towards the resting surface on the joining head, and the recessed region for yarn positioning provided in the separator baffle can be variously profiled.

Because of the presence of the separator baffle according to the invention, the two parts into which the chamber is divided are physically separated from each other, and because of the recessed region of the separator baffle the yarns to be joined which are introduced into the two parts of the chamber through the longitudinal slot become positioned in a constant and well defined position at the centre of the chamber and thus within the immediate vicinity of the points at which the nozzles open into the two parts of the chamber. In addition the opposing air swirls created in the two parts of the chamber are unable to influence each other. It should be noted that these air swirls operate within the two parts of the chamber both in the same direction as the original twist of the yarns to be joined, i.e. in the sense of twisting the yarns, which have already been untwisted by a preliminary pretreatment operation.

The problem of excessive air escape from the two lateral ports in the chamber, this being particularly critical in the case of short fibre and/or soft twist yarns, is also solved by the device according to the invention in that a desired air quantity is discharged at the centre of the chamber, between its two parts, through the free vent space created by the fact that the separator baffle terminates within the transverse central fissure of the joining head at a certain distance from the resting surface for the cover if this has a solid contact surface, and/or by virtue of a transverse fissure in said contact surface of the cover.

Some embodiments of the invention are described in greater detail hereinafter with reference to the drawings, in which:

DETAILED DESCRIPTION OF THE PREFERRED EMBODIMENTS

Figure 2:
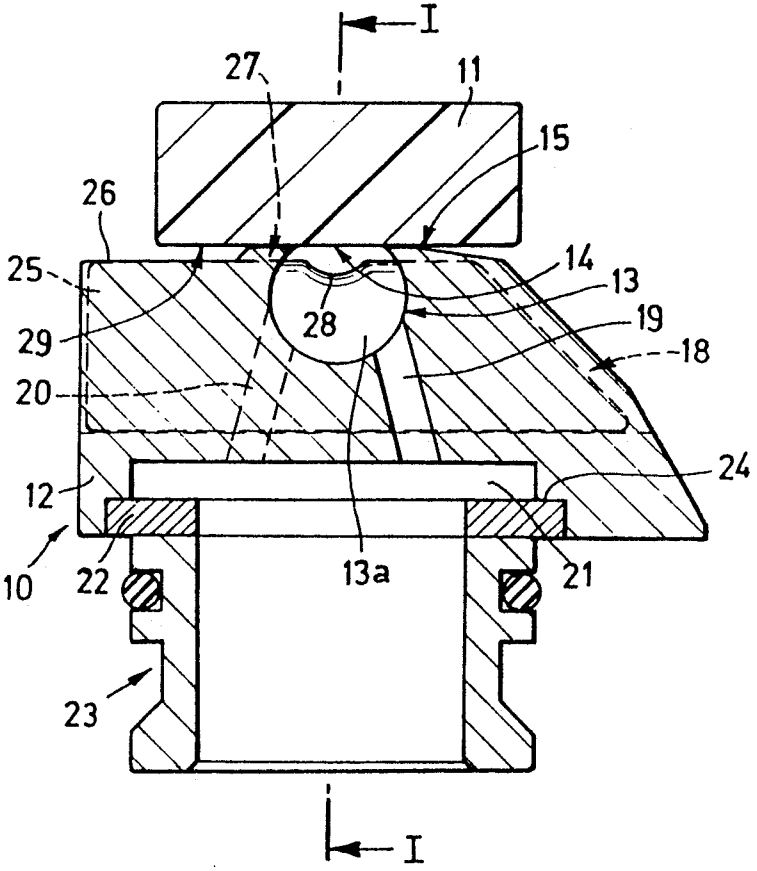
FIGS. 1 and 2 represent a first embodiment of a joining head and cover, shown in longitudinal section on the line I—I of FIG. 2 and in cross-section on the line II—II of FIG. 11 respectively.
Figure 1:
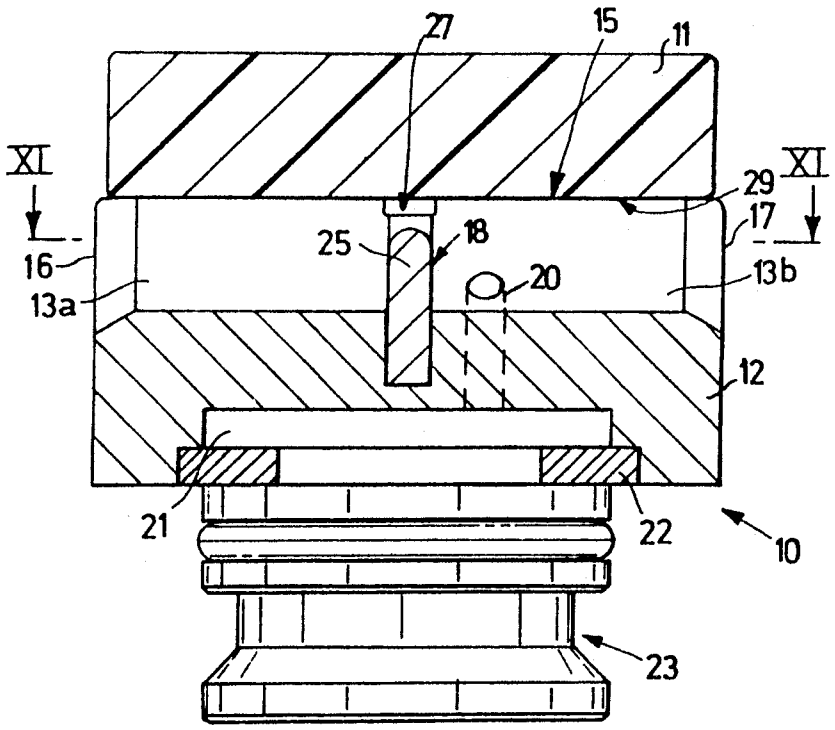

With reference firstly to FIGS. 1 and 2, these show a joining head indicated overall by 10, and a relative cover 11. The joining head 10 consists of a body 12 normally of shaped aluminium. Within the body 12 a longitudinal joining chamber 13 is provided, of circular cross-section in the illustrated case. A longitudinal slot 14, also provided in the body 12, connects the longitudinal chamber 13 to a resting surface 15 formed on the body 12, the yarns to be joined (not shown) being introduced into the chamber via the slot 14 from opposite ends and entering the chamber through its lateral end ports 16, 17.

Starting from a certain depth in the body 12 a central fissure 18 is provided therein transverse to the longitudinal axis of the chamber 13, to connect the chamber 13 to the outside and, in particular, also to the resting surface 15. The transverse fissure 18 divides the chamber 13 into a part **13*a* disposed on one side of a transverse plane of symmetry and a part 13*b*** disposed on the other side of this transverse plane of symmetry.

For feeding compressed air into the two parts **13*a* and 13*b* of the chamber 13, two holes 19, 20 are provided in the body 12 to form air nozzles, which open into the base of the parts 13*a* and 13*b* of the chamber respectively and are orientated towards the longitudinal fissure 14. The nozzles 19, 20 are positioned respectively on one side and on the opposite side of a longitudinal plane of symmetry through the chamber 13. In addition, the axis of each nozzle 19, 20 advantageously forms a certain angle (see FIG. 2) with the straight line of intersection between the transverse plane containing said axis and the longitudinal plane of symmetry. With this arrangement of the air nozzles 19 and 20, opposing air swirls are created in the two parts 13*a* and 13*b* of the chamber 13. Specifically, in the illustrated case the arrangement is such that, viewed from the lateral end port 16 of the chamber 13, the air swirl in the part 13*a* is anticlockwise (or left handed) and the air swirl in the part 13*b* is clockwise (or right handed) about the yarns inserted into the two parts of the chamber. This arrangement is suitable for a chamber intended to join yarns having an original Z twist, in that the air swirls cause twisting of the yarns in the same direction as their original twist. If the chamber is used for joining yarns having an original S twist, the arrangement of the air nozzles opening into the two parts 13*a* and 13*b*** of the chamber must be the reverse of that shown.

The air nozzles 19, 20 through which compressed air can be fed into the parts **13*a* and 13*b* of the chamber 13 extend from a prechamber 21 provided in the body 12 on the opposite side to the resting surface 15, said prechamber being partially closed by the flange 22 of a compressed air connector 23, said flange being forcibly inserted into a cavity in the body 12 and resting on a circular step 24 provided around the prechamber 21**.

Within the transverse central fissure 18 there is disposed a separator baffle 25 which partly closes the fissure and terminates within the fissure with a surface 26 (upper in FIGS. 1 and 2) spaced apart from the resting surface 15 of the body 12. Consequently within the fissure 18 there remains a certain free space 27 between the surface 26 of the baffle 25 and the resting surface 15. The surface 26 of the baffle 25 comprises a substantially semicircular recessed region 28 aligned with the two parts **13*a* and 13*b* of the chamber 13. Said free space 27 and said recessed region 28 in the separator baffle 25 therefore produce partial communication between the two parts 13*a* and 13*b* of the chamber 13, enabling a certain quantity of the compressed air fed into the two parts 13*a* and 13*b* via the air nozzles 19 and 20 to be discharged to the outside at the centre of the chamber 13. The recessed region 28 of the separator baffle 25 ensures constant and properly defined positioning at the centre of the chamber 13 for the yarns to be joined when inserted into the two parts 13*a* and 13*b* of the chamber 13 via the longitudinal slot 14**.

In the embodiment shown in FIGS. 1 and 2 the cover 11 has a flat contact surface with which, when in its closed position illustrated, the cover 11 rests on the resting surface 15 of the body 12 of the joining head 10, so closing the longitudinal slot 14 provided in the body 12. At the transverse central fissure 18, the contact surface 29 of the cover 11 also frontally closes the fissure 18 itself (see FIG. 1), so that the free air vent space 27 at the centre of the chamber 13 is limited to the gap between said contact surface 29 of the cover 11 and the surface 26 of the separator baffle 25, and the recessed region 28 of said surface 26 respectively (see FIG. 2).

Figure 4:
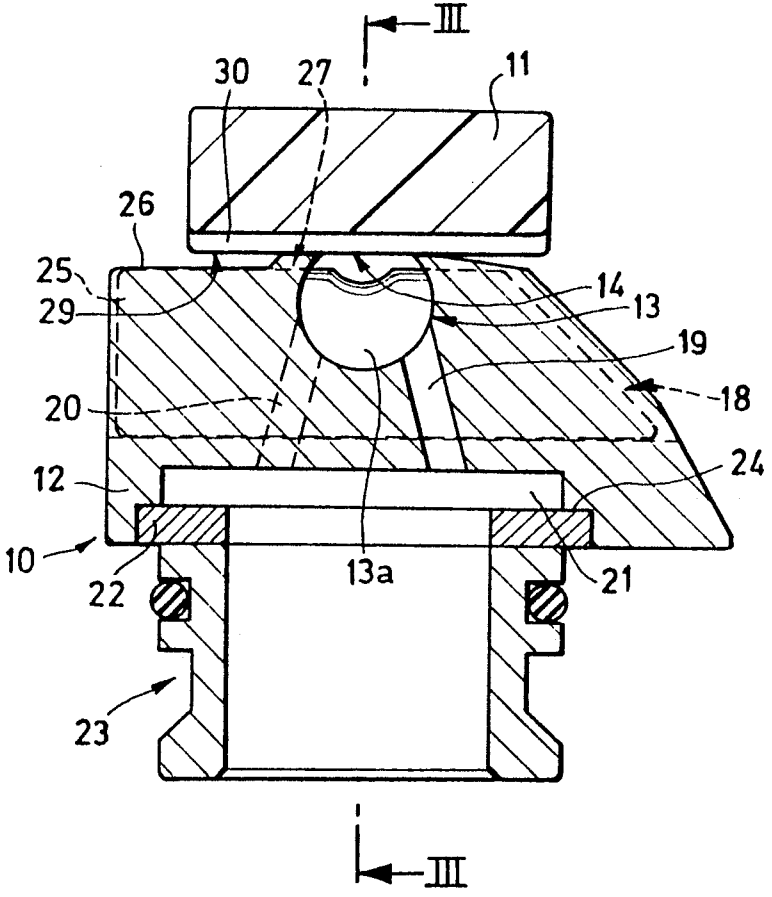
FIGS. 3 and 4 show a second embodiment of a joining head and cover, shown in longitudinal section on the line III—III of FIG. 4 and in cross-section on the line IV—IV of FIG. 11 respectively.
Figure 3:
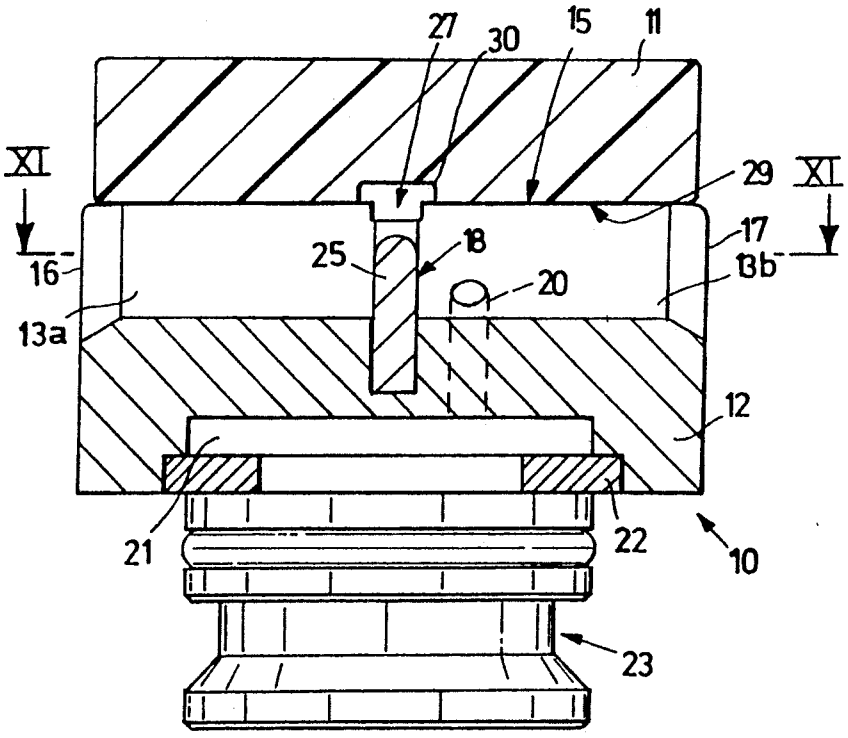

If it is desired to discharge a greater quantity of air at the centre of the chamber 13, said free vent space can be increased by also providing a transverse fissure 30 in the cover 11, ie in its contact surface 29, in the region which when the cover is closed faces the transverse central fissure 18 provided in the body 12 of the joining head 10, as shown in FIGS. 3 and 4. The remainder of the embodiment shown in these figures corresponds to that shown in FIGS. 1 and 2, identical parts being indicated by the same reference numerals. The fissure 30, which extends along the entire width of the cover 11, can have a width slightly greater than the width of the transverse fissure 18 provided in the body 12 of the joining head.

Figure 6:
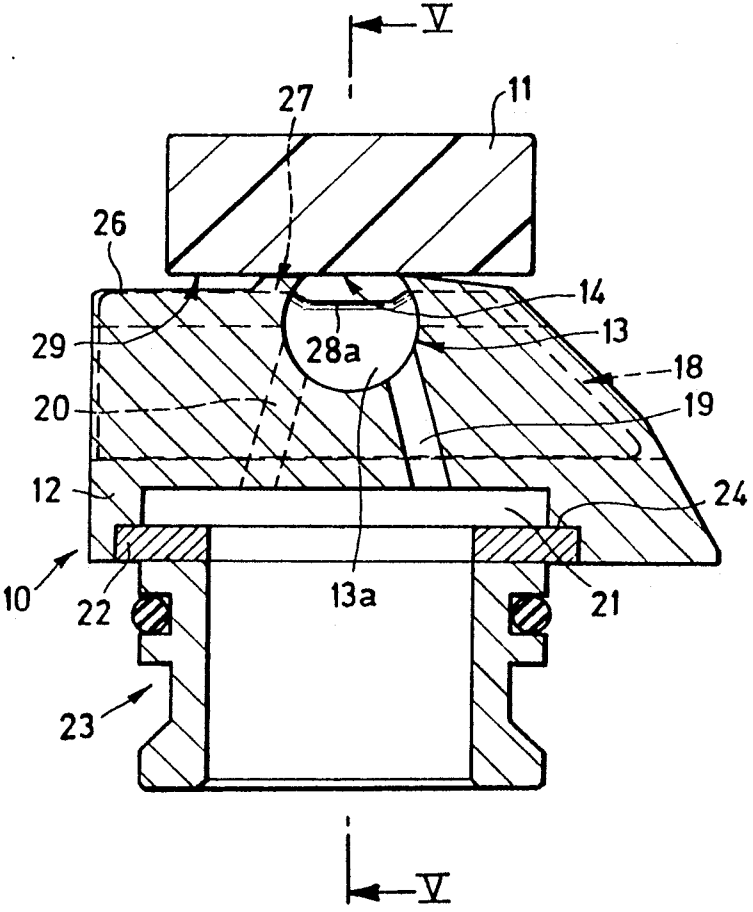
FIGS. 5 and 6, 7 and 8, and 9 and 10 show a third, a fourth and a fifth embodiment in the same views as FIGS. 1 and 2.
Figure 5:
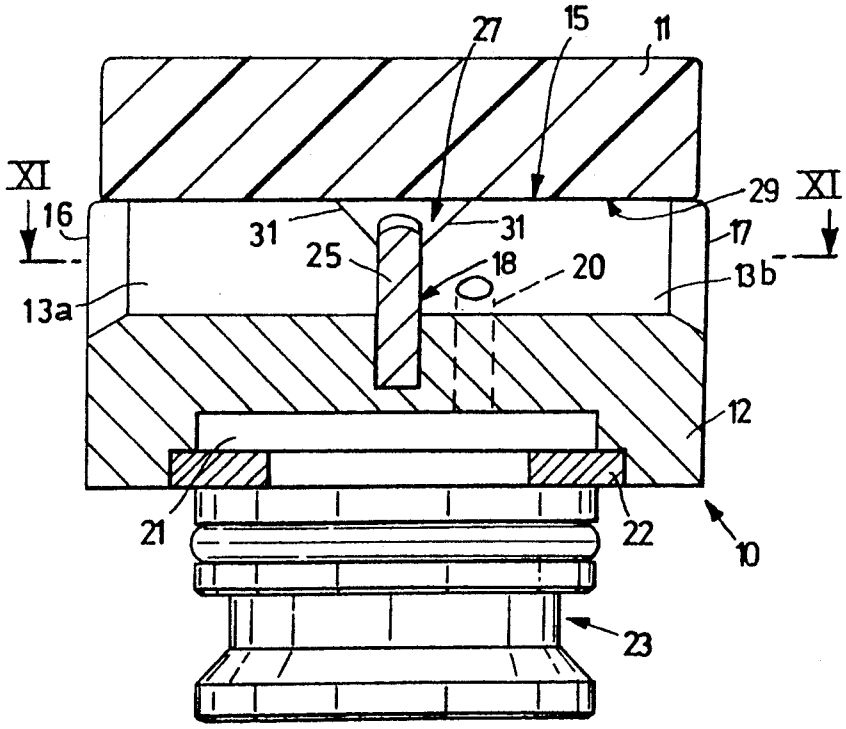

The embodiment shown in FIGS. 5 and 6 corresponds, with the following exceptions, to that of FIGS. 1 and 2, identical parts being indicated by the same reference numerals. Firstly, the transverse central fissure 18 provided in the body 12 comprises bevels 31 at its opening towards the resting surface 15, so that it widens towards said resting surface to thus increase the free space 27 for air venting at the centre of the chamber 13 (see FIG. 5). In addition, in this case the profile of the recessed region in the surface 26 of the separator baffle 25, and indicated by **28*a* in FIG. 6, is modified in that said recessed region 28*a* has a smaller depth than that of the recessed region 28 of the embodiments shown in FIGS. 1 to 4**.

Figure 8:
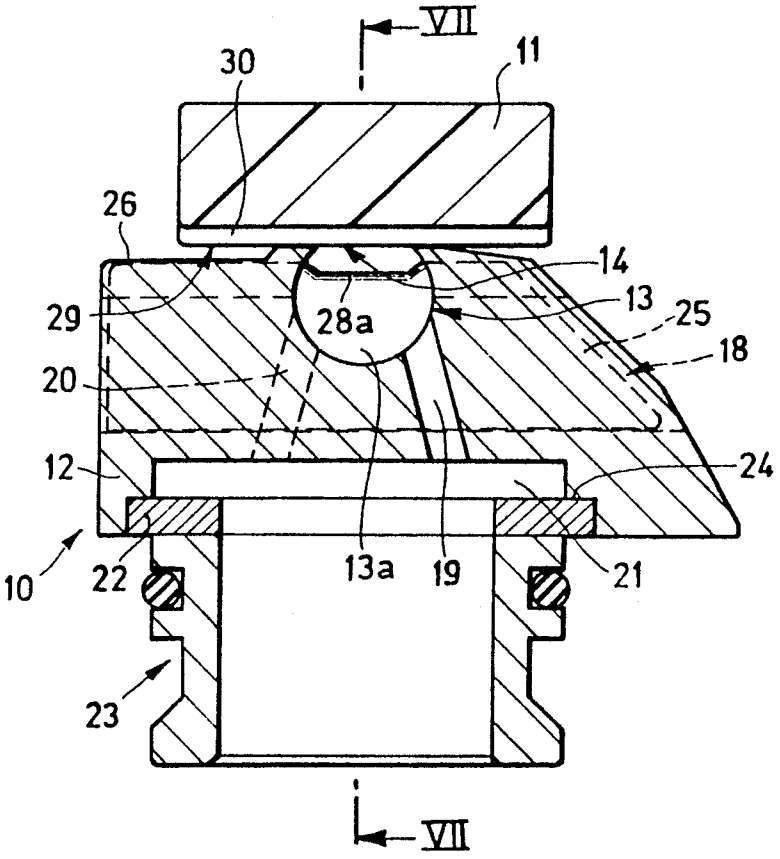
Figure 7:
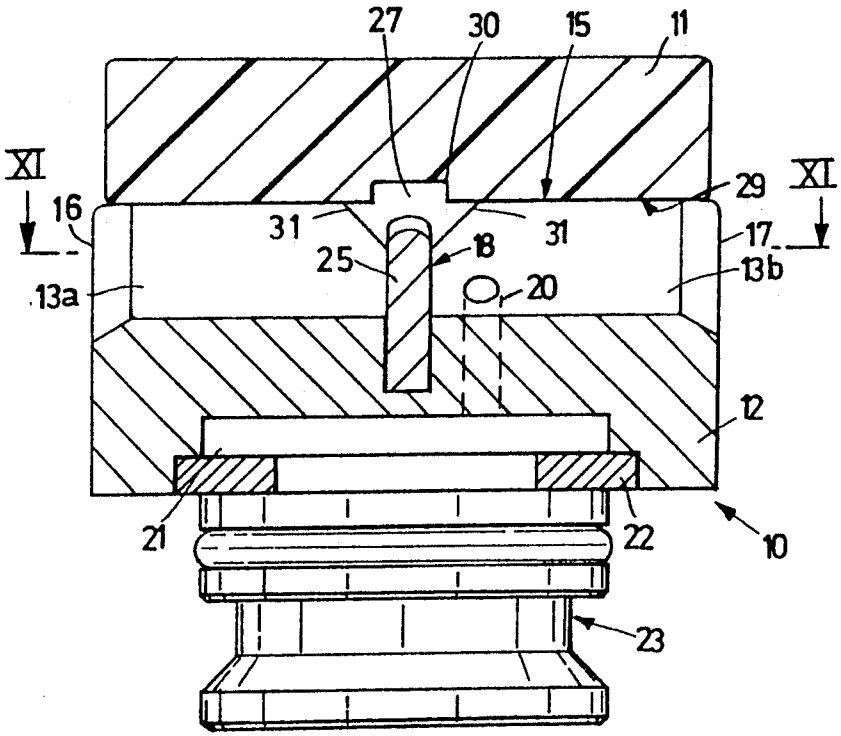

FIGS. 7 and 8 show an embodiment which differs from that of FIGS. 5 and 6 only in that a cover 11 with a transverse fissure 30 is used.

Finally, the embodiment shown in 9 and 10 differs from that of FIGS. 3 and 4 only in that the separator baffle 25 comprises a relatively deep groove **28*b*** as its recessed region for yarn positioning.

Figure 10:
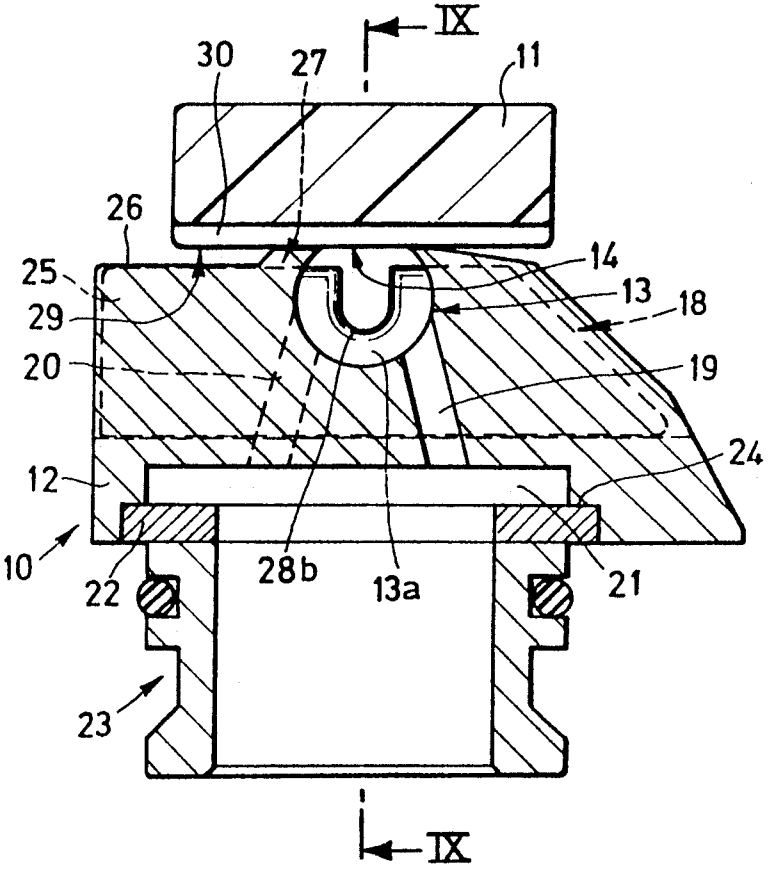
Figure 9:
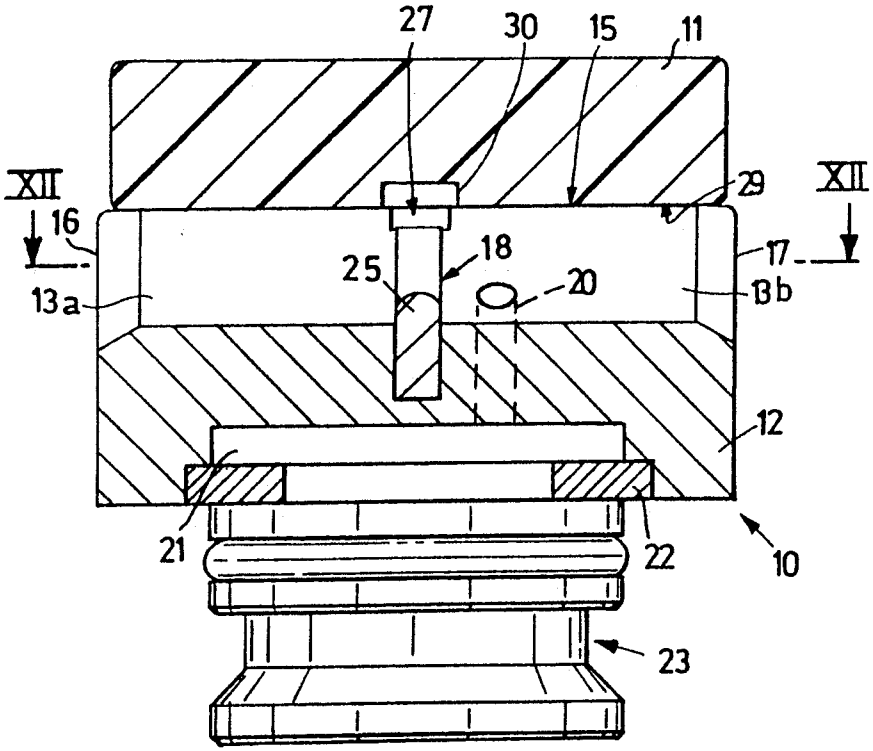
Figure 11:
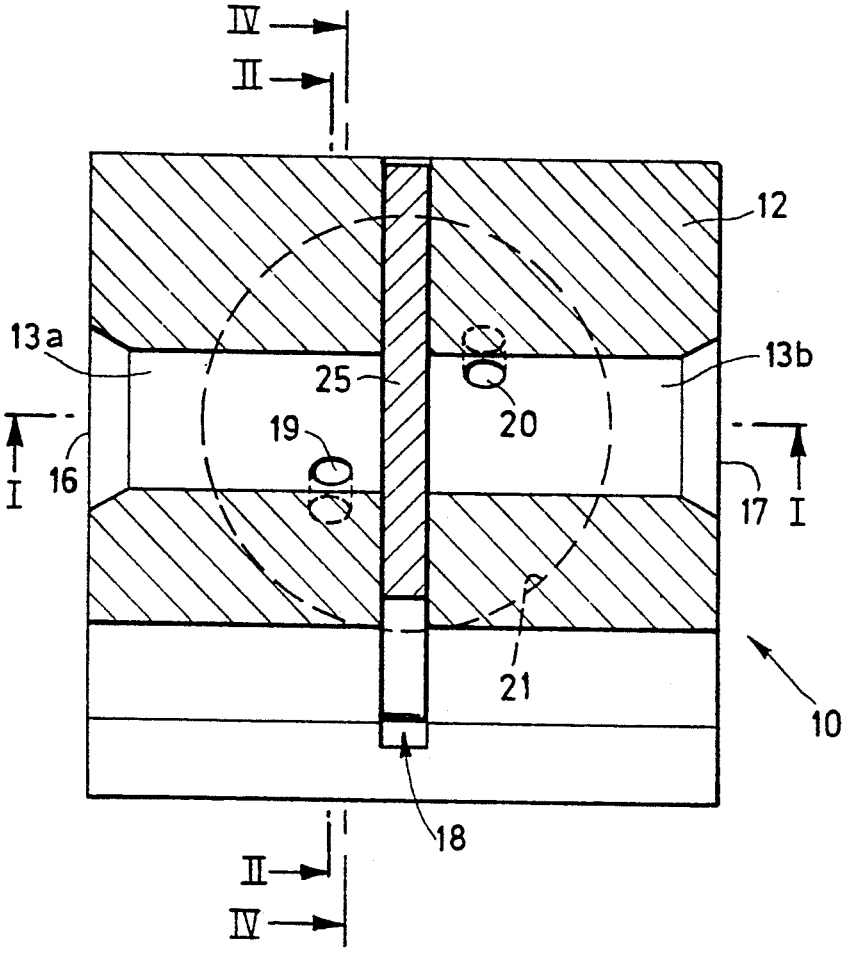
FIG. 11 is a horizontal section view taken along line XI—XI of FIG. 1.
Figure 13:
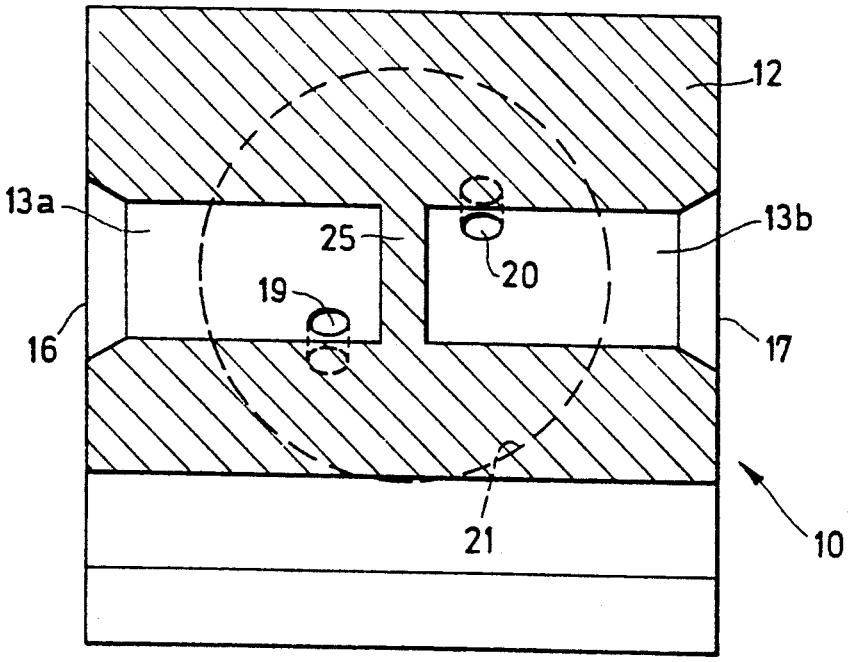
FIG. 13 is a horizontal section view, corresponding to FIG. 11, showing an embodiment of the instant invention in which an integrally formed baffle is shown.
Figure 12:
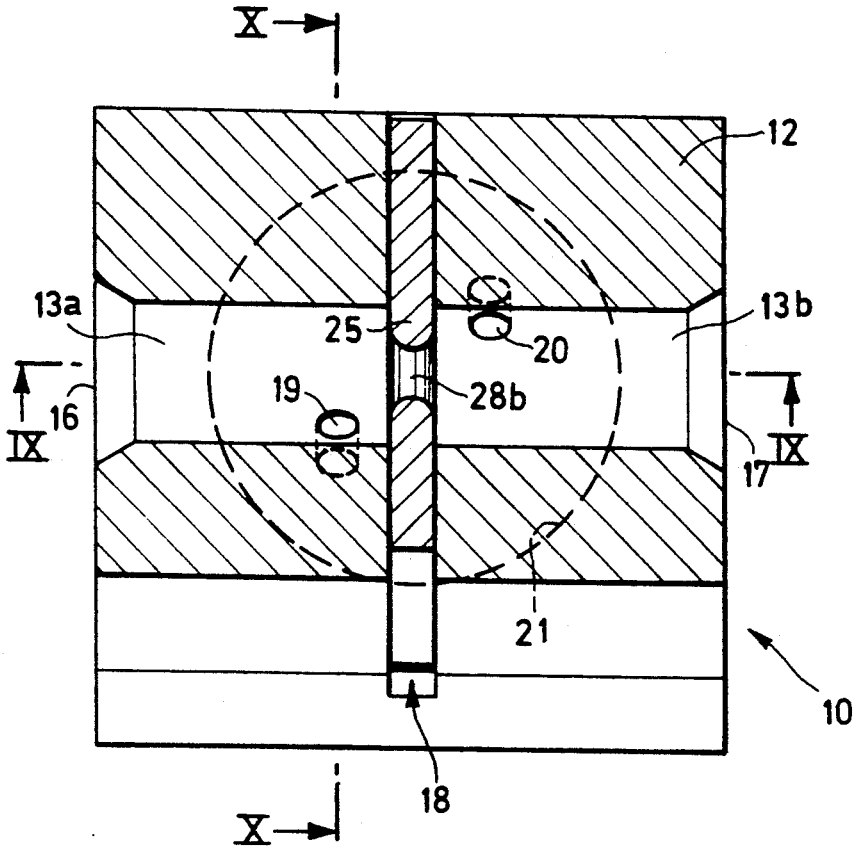
FIG. 12 is a horizontal section view taken along line XII—XII of FIG. 9.

FIGS. 11 and 12 show a horizontal section view of two embodiments of the present invention. Specifically, FIGS. 11 and 13 show lateral end ports 16 and 17, and corresponding longitudinal chambers **13*a* and 13*b*. Nozzles 19 and 20 are received into chambers 13*a* and 13*b* respectively. In addition, the transverse central fissure 18 is shown dividing the chamber 13 into parts 13*a* and 13*b*. Within the transverse central fissure 18 is disposed a separator baffle 25. The primary feature which distinguishes FIG. 11 from FIG. 12 is the deep groove 28*b* as best shown in FIG. 10**.

FIG. 13 shows an embodiment of the instant invention similar to FIG. 11 in which the separator baffle is integrally formed with the body 12, thus eliminating the central fissure 18.

All the embodiments described by way of example have the common characteristic that the two parts into which the longitudinal chamber is divided are physically separated from each other by the separator baffle disposed in the transverse central fissure. This separator baffle may be forcibly inserted into the transverse fissure, but it can also be formed directly in the joining head as an integral part thereof. Because of the presence of this separator baffle the opposing air swirls created in the two parts of the chamber do not interact in practice, this characteristic being enhanced by the fact that although the separator baffle is present there still remains a free space for venting air at the centre of the chamber, which vent space can be suitably sized, bearing in mind the possible presence of a transverse fissure in the cover, to allow any desired quantity of air to be discharged centrally, in order to limit the discharge of air at the two lateral ports of the chamber.

Because of the recessed region in its upper surface, the separator baffle also results in constant and properly defined positioning, between the two parts of the chamber, of the yarns to be joined at the centre of said chamber, so that the yarns are exposed in a constantly equal manner to the opposing air swirls created in the two parts of the chamber, to thus obtain yarn joints with more uniform characteristics.

I claim:

1. A device for joining textile yarns by compressed air, comprising a joining head containing a longitudinal chamber with free exit ports at its ends, a longitudinal slot for introducing the yarns to be joined in the longitudinal chamber and providing communication between the chamber and a resting surface on the joining head, a transverse central air fissure connecting a center of the chamber to an outside environment and dividing the chamber into two parts, said transverse central air fissure extending transverse with respect to said longitudinal chamber and adapted to transversely vent said compressed air to said outside environment, and compressed air nozzles opening into the two parts of the chamber, at least one of said nozzles opening into one part of the chamber and being disposed on one side of a longitudinal plane of symmetry through the chamber, and at least a further one of said nozzles opening into the second part of the chamber and being disposed on an opposite side of said longitudinal plane of symmetry, and further comprising for said longitudinal introduction slot a closure cover controllable to enable one of its surfaces to be brought into temporary contact with said resting surface on the head, characterized in that in said central transverse fissure there is disposed a separator baffle which partly closes the fissure and terminates within the fissure at a distance from the resting surface on the joining head, said separator baffle comprising a recessed region for yarn positioning which is aligned with the two parts of the chamber.

2. A joining device as claimed in claim 1, characterized in that the contact surface of the cover comprises a transverse fissure in that region of the cover which faces the transverse central fissure in the joining head when the cover is in contact with said resting surface on the joining head.

3. A joining device as claimed in claim 1, characterised in that the transverse central fissure provided in the joining head is bevelled towards the resting surface on the joining head.

4. A joining device as claimed in claim 1, characterised in that the separator baffle is either forcibly inserted into the transverse central fissure of the joining head or is formed integrally with the body of the head.

5. A joining device as claimed in claim 1, characterised in that the recessed positioning region of the separator baffle is semicircular or of groove shape.

6. A device for joining textile yarns by compressed air, comprising a joining head containing a longitudinal chamber with free exit ports at its ends, a longitudinal slot connecting the longitudinal chamber to a resting surface on the joining head whereby the textile yarns to be joined are introduced into the longitudinal chamber via opposite ends of the longitudinal slot, a transverse central air fissure extending transversely to a longitudinal direction of the longitudinal chamber and dividing the chamber into two parts, said transverse central air fissure adapted to transversely vent said air to an outside environment, and compressed air nozzles opening into the two parts of the longitudinal chamber, at least one of said nozzles opening into a first one of the two part of the longitudinal chamber and being disposed on one side of a longitudinal plane of symmetry through the longitudinal chamber, and at least a further one of said nozzles opening into a second one of the two parts of the longitudinal chamber and being disposed on an opposite side of said longitudinal plane of symmetry, and further comprising for said longitudinal slot a closure cover controllable to enable one of its surfaces to be brought into temporary contact with said resting surface on the head, characterized in that in said transverse central air fissure there is disposed a separator baffle which partly closes the transverse central air fissure and terminates within the transverse central air fissure at a distance from the resting surface on the joining head, said separator baffle comprising a recessed region for yarn positioning which is aligned with the two parts of the chamber.

* * * * *